US005307608A

United States Patent [19]

Muir et al.

[11] Patent Number: 5,307,608

[45] Date of Patent: May 3, 1994

[54] METHOD AND APPARATUS FOR PACKAGING ASPHALT

[75] Inventors: Raun S. Muir, Woods Cross, Utah; Charles S. Rogers, Fredonia, Ariz.

[73] Assignee: Petro Source Refining Partners, Houston, Tex.

[21] Appl. No.: 976,192

[22] Filed: Nov. 13, 1992

Related U.S. Application Data

[63] Continuation-in-part of Ser. No. 682,192, Apr. 8, 1991, abandoned.

[51] Int. Cl.[5] ..... B65B 63/08; B65B 61/24

[52] U.S. Cl. ..... 53/440; 53/127; 53/250; 53/473

[58] Field of Search ..... 53/440, 431, 473, 469, 53/468, 467, 428, 127, 249, 284.5

[56] References Cited

U.S. PATENT DOCUMENTS

| | | | |
|---|---|---|---|
| 1,297,917 | 3/1919 | Schmitt . | |
| 2,167,392 | 7/1939 | McDonald . | |
| 2,908,936 | 10/1959 | Kilborn | 264/237 X |
| 3,469,363 | 9/1969 | Berckmoes | 53/440 |
| 3,553,303 | 1/1971 | Zavasnik | 264/237 X |
| 3,564,808 | 2/1971 | Kent | 53/440 |
| 3,832,825 | 9/1974 | Dunbar | 53/440 X |
| 3,837,778 | 9/1974 | Parker | 425/256 |
| 3,987,602 | 10/1976 | Stahl | 53/440 |
| 4,004,619 | 1/1977 | Eddlemon et al. | 141/11 |
| 4,054,632 | 10/1977 | Franke | 264/145 |
| 4,137,692 | 2/1979 | Levy | 53/440 |
| 4,450,133 | 5/1984 | Cafarelli | 264/237 X |
| 4,627,224 | 12/1986 | Hamamoto et al. | 53/502 |
| 4,771,681 | 9/1988 | Nagata | 99/483 |
| 4,932,513 | 6/1990 | Michimae et al. | 198/397 |

FOREIGN PATENT DOCUMENTS 2140595 8/1971 Fed. Rep. of Germany .

*Primary Examiner*—James F. Coan
*Attorney, Agent, or Firm*—Arnold, White & Durkee

[57] ABSTRACT

An apparatus and method for packaging asphalt, which includes liquid cooling means, such as a pool or water sprayer, and an elongated flat conveying surface, such as the surface of a conveyor belt, for transporting asphalt molds into said liquid cooling means after said asphalt molds have been lined with plastic and filled with hot asphalt.

12 Claims, 6 Drawing Sheets

METHOD AND APPARATUS FOR PACKAGING ASPHALT

This application is a continuation-in-part of Application Ser. No. 682,192, filed Apr. 8, 1991, now abandoned.

BACKGROUND OF INVENTION

A. Field of Invention

This invention relates to asphalt packaging, in particular, to an improved apparatus and method for packaging asphalt.

B. Related Art

The present invention constitutes an improvement over the invention described in the application Ser. No. 682,192, which involved packaged roofing asphalt and a method for making it.

The packaged roofing asphalt of the earlier invention comprised a molded block of solid asphalt contained in a flexible film consisting essentially of polypropylene and being the sole containment means for the block. The film has a melting point between about 275° F. and about 335° F. (for example, about 315° F.) and a thickness between about 1.0 and 1.8 mils.

The method of the earlier invention involved the steps of providing a mold of a rigid material, lining the mold with a flexible film, pouring liquid roofing asphalt into the film-lined mold, cooling the mold to solidify the asphalt, and removing the solidified asphalt covered with the flexible film to provide an asphalt packaging. The roofing asphalt of the packaging is asphalt material typically used in roofing applications. Such materials have a melting point between about 170° F. and 220° F.

In the earlier invention, the flexible film is the sole containment means for the asphalt and consists essentially of polypropylene. It has been found that a flexible film of polypropylene which has the particular thickness and particular melting point recited above has the proper balance of strength for containing the liquid asphalt during the packaging operation and meltability to allow it to melt quickly and completely in a roofing asphalt vat used in the conventional manner.

In the prior invention, asphalt 101 is formed into a block, and is covered by polypropylene film 103. The asphalt 101 need not be completely covered by the film 101, but molding techniques usually required to form the package of the invention would generally require that the bottom and the four sides be covered. The package is dimensioned to be convenient for storage, handling and insertion into a roofers asphalt vat. A preferred size is 22 inches long, 11 inches wide, and 6 inches high, resulting in a package with 50 pounds of asphalt. This size permits easy handling, and can be easily stacked for storage and shipping with little void space. FIG. 7 shows the stacking of packages 101 on a conventional shipping pallet 107. Referring to FIG. 7, the packaging may have a portion of the top surface 105 uncovered by the film to expose a surface of asphalt. Preferably more than ¾ of the top surface is covered by the polypropylene film 103. For the above 22×11×6 package the exposed portion is about 1 TM ×14 inches. When such packages are stacked on a pallet, the top asphalt surface of a package will adhere to the bottom of an adjacent package, stabilizing the stack. However, packages 101 may still be easily separated and removed when unstacked. The preferred size of the package also allows insertion of the whole package into an asphalt vat without having to cut or chop the package into small pieces. Its dimensions also allow the package to melt quickly in the vat. Since the film is not removed before inserting the package to the vat, there is no packaging waste and cleanup. The thin-walled polypropylene film material quickly melts with the asphalt and leaves no solid or partially melted residue in the asphalt melt.

The previous invention provided a general manufacturing procedure, which included the steps of providing a rigid, heat resistant mold, lining the mold with a polypropylene film and pouring liquid asphalt into the lined mold. Such a mold 401 is illustrated in FIGS. 8A and 8B. The polypropylene film 403 is inserted in the mold 401 as shown in FIG. 8B, to line the mold 401 with polypropylene film 403. The mold 401 may be of any suitable material. Plastics, cellulosic materials, and the like may be used if the mold is to be used once or only a few times. For more durable molds, a heat resistant plastic material, or preferably sheet or cast metal, is used.

The polypropylene film 403 has the melting point and thickness recited above. Higher melting point and thicker materials do not completely melt in the asphalt vat, while lower melting point and thinner materials do not have the strength required for the manufacture of the packaging. The polypropylene film 403 may be in the form of a sheet or in the form of a bag, preferably dimensioned to be easily inserted into the mold 40 and also to cover all the surfaces of the mold to prevent the asphalt from adhering to the mold 401.

Asphalt in a liquid form is poured into the mold. FIG. 9 is a cross-section showing mold 501, film 502 lining the mold, and asphalt 505 being poured into the mold 501. The asphalt is poured at a temperature between about 280° F. and 310° F. Below this temperature range the asphalt is too viscous, and above this it may damage the film. The optimum temperature range is about 295° F.

After pouring the asphalt into the mold, the portion of the polypropylene film extending above the sides of the mold is folded over the top of the liquid asphalt. Preferably, the portion of the film folded over the top is sized to not completely cover the top of the package and leave an exposed surface of asphalt. In the prior invention, the resulting package will have a top surface with the asphalt partially exposed.

The earlier invention provided cooling means, e.g. a water bath, a jacketed mold, or the like, to accelerate the cooling of the asphalt in the mold. The earlier invention provided a trough containing water, with the molds placed in the trough to cool the molds. The molds with the melted asphalt were charged into one end of the trough and moved though the trough, e.g. by floating the molds or by a conveyor means, while the water cooled the outer surface of the molds. The cooled molds with the solid asphalt were then discharged from the other end of the trough. When the asphalt was sufficiently cool to be solid, the asphalt covered by the polypropylene film was removed from the mold.

U.S. Pat. No. 3,837,778 to Parker also refers to a packaging method utilizing water troughs. That patent states that hot asphalt is poured into a mold or boat that is lined by polyester film at a charging station, such boat being floated on a stream of cooling water that carries the boat and its cooling contents to a discharge station where the cooled asphalt enveloped in the resin film is removed from the boat as the packaged product with the boat being returned to the charging station for reuse.

One of the shortcomings of these prior systems is their elaborate and complicated construction. In contrast, the present invention offers a far more effective and less expensive system. Further, the present invention presents less potential for mechanical difficulties and greater ease of construction and maintenance than prior systems.

SUMMARY OF INVENTION

The present invention is directed generally to an apparatus and method for packaging asphalt. The apparatus includes cooling means and a substantially planar elongated conveying surface for transporting asphalt-filled molds for contact with the cooling means. In a specific embodiment of the invention, the cooling means comprise a liquid coolant, preferably a pool or pond of water. The elongated conveying surface preferably comprises the outer surface of a movable conveyor belt that is partially submerged in the pool. The apparatus preferably also includes means for filling molds with hot asphalt and means for removing filled molds from the pool.

In a preferred embodiment of the invention, the conveying surface is slanted with respect to the surface of the water in the pool. The slanted conveying surface should be partially submerged to provide for gradual immersion of the molds into the water. When the conveying surface is the outer surface of a movable conveyor belt, the belt is out of the water in a first position and submerged in a second position. Molds are transported on the conveying surface from the first position to the second position, either by movement of the conveying surface or by movement of the molds relative to the conveying surface. In the first position, an empty mold may be placed on the conveying surface. After being lined with a packaging material, filled with hot molten asphalt and moved to the second position, the filled mold begins to float on the water and move away from the conveying surface.

In another aspect, the invention is directed to a method of packaging asphalt. The method broadly comprises transporting an asphalt-filled mold into cooling means on an elongated, substantially planar conveying surface. Where the cooling means includes a pool of water, the mold is transported at a gradual angle or slant relative to the surface of the water, thus gradually entering the water beginning with one end of the mold. Preferably, the conveying surface is the outer surface of a slanted, movable conveyor belt which is at least partially submerged in the water. The method of a preferred embodiment of the invention additionally includes the steps of lining the mold with a plastic bag and filling the mold with asphalt prior to contacting the mold with the liquid cooling means and removing the mold from the liquid cooling means. Preferably, the mold is floatable when filled with hot asphalt and can be removed from the pool after the asphalt has been cooled and hardened.

DETAILED DESCRIPTION OF INVENTION

Figure 1:
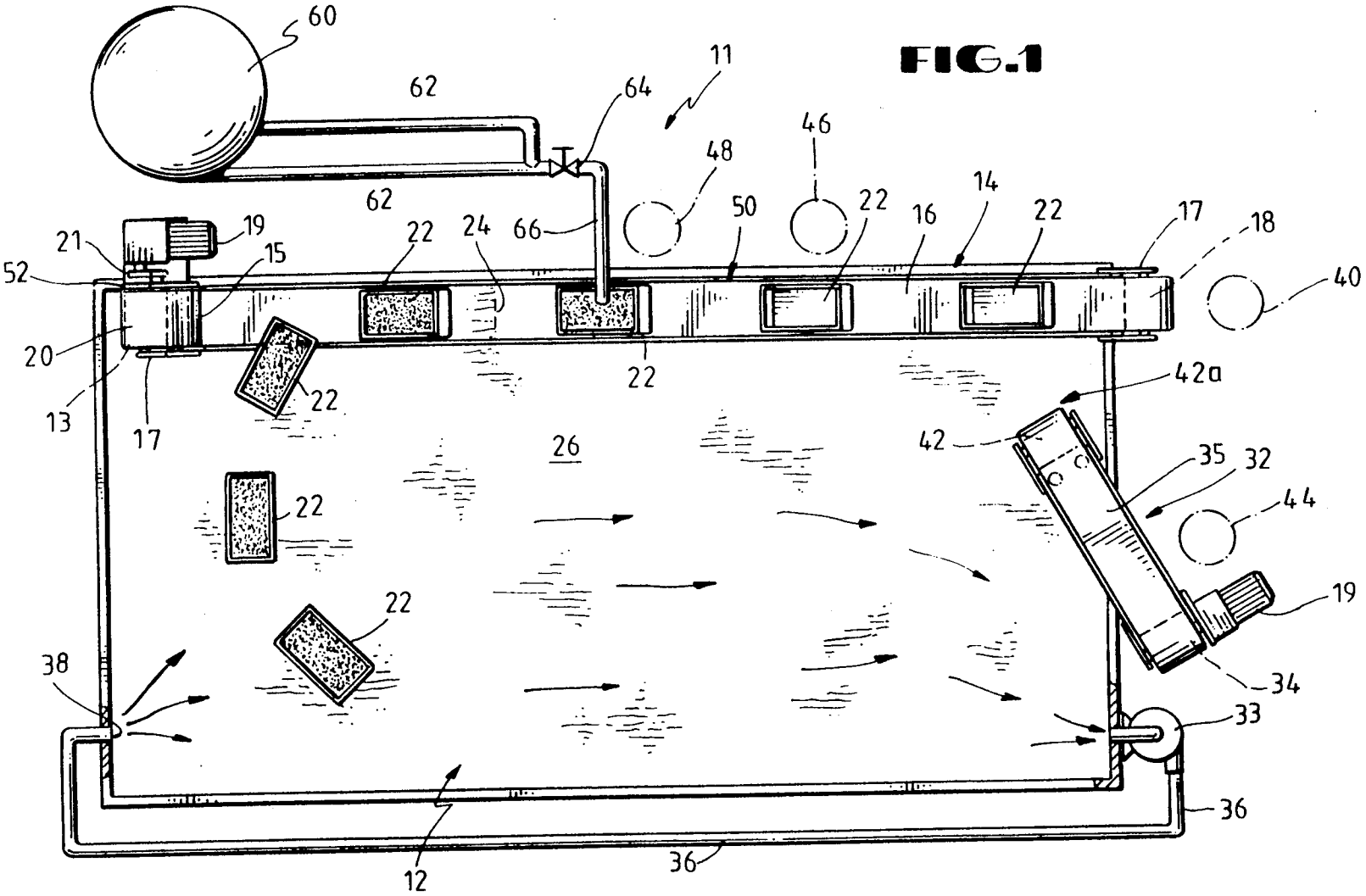
FIG. 1 is a top plan view of a specific embodiment of the packaging apparatus of the present invention.

In a broad aspect, the present invention is directed to an improved method and apparatus for packaging asphalt. The method may be carried out in connection with the apparatus. Different embodiments and aspects of the apparatus are shown in FIGS. 1–4, where like reference numerals refer to like parts.

The method of this invention includes the step of transporting a filled mold of asphalt on an elongated planar conveying surface into cooling means that preferably include a liquid coolant such as a pool of water. Preferably, the method also includes the steps of placing an empty mold on the conveying surface; lining the mold with packaging material such as a plastic liner; and filling the lined mold with hot asphalt prior to contacting the filled mold with the liquid coolant. Preferably, the mold is removed from the liquid coolant after the hot asphalt in the mold has cooled and hardened.

A specific embodiment of the method includes the step of providing for gradual, lengthwise entry of a filled mold into a pool of water. That is, where the mold is shaped like a rectangular box having two ends, one end of the mold is contacted with the water before the other end contacts the water. This gradual entry may be accomplished by transporting the mold into the water on a planar, slanted conveying surface such as the conveyor belt shown in FIGS. 3 and 4.

Figure 9:
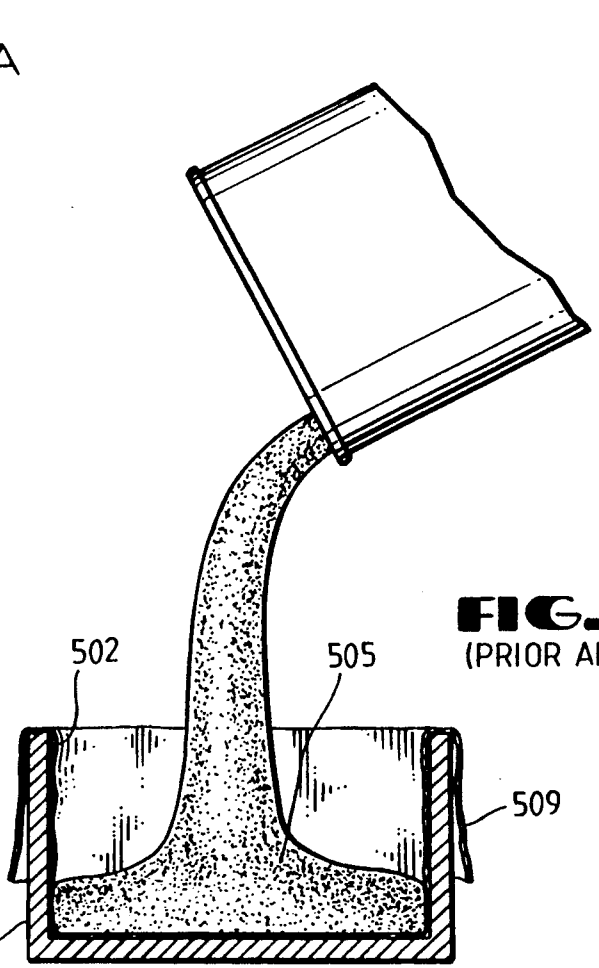
FIG. 9 (PRIOR ART)
FIG. 9 is a cross-sectional view of the mold of FIG. 8 with liquid asphalt being poured into the mold.
Figure 8A:
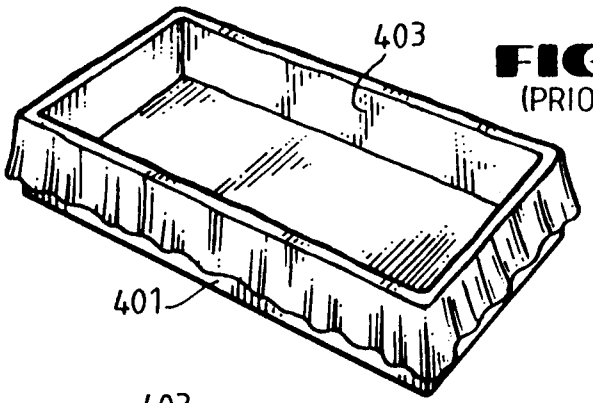
FIG. 8A (PRIOR ART)
FIGS. 8A and 8B illustrate the formation of packages of the prior invention with a polypropylene film in the form of a bag lining the mold.
Figure 8B:
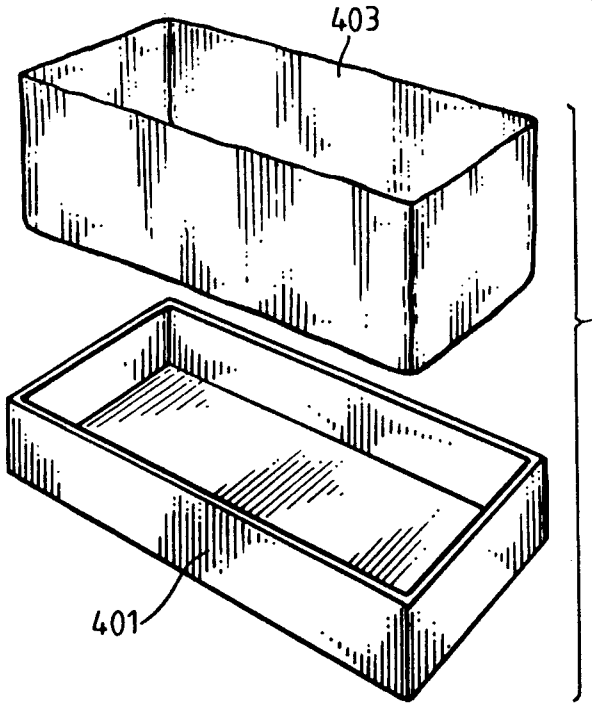
FIG. 8B (PRIOR ART)

Preferably, the mold that is filled with hot asphalt and transported into the water is capable of floating after being filled. Floating molds made of high density polyethylene are shown in Parker, U.S. Pat. No. 3,837,778. However, a preferred mold is that described in the earlier application and duplicated in FIG. 9 herein. Persons skilled in the art will recognize that a mold's buoyancy will depend on its design and the materials used in its construction. In general, a metallic or plastic rectangular box-like mold is suitable, particularly one that is capable of fitting on the conveying surface without falling off. For example, a mold that is 22 inches long and 10 ½ inches wide is suitable for use with a 12 inch wide conveyor belt. It has been discovered that a mold 8 inches in height will float, partially submerged, when filled with no more than about 6 inches of roofing asphalt. Too much asphalt in the mold will cause the mold to sink in the water.

Roofing asphalt has a melting or softening point of between about 175° F. and 220° F. Thus, it is contemplated that hot roofing asphalt may have a temperature in that range when introduced to the empty mold in a molten state during the filling step. Each mold is preferably lined with packaging material prior to being filled with hot asphalt. Although the packaging material is preferably a plastic bag made of a single sheet of polypropylene, the composition of the bag is not critical to this invention, and other plastics including but not limited to polyethylene may also be utilized.

The cooling means of this invention are designed to lower the temperature of the asphalt. Cooling is preferably accomplished by contact between a liquid coolant and the outside of the mold to gradually remove heat from the molten asphalt until it cools and hardens. Generally, it has been found that the hardening of roofing asphalt takes at least about eight hours when introduced into molds described herein, which are then placed in a pool of water. The method of the invention will be discussed below in greater detail with reference to the apparatus.

The apparatus in a broad aspect includes cooling means and a substantially planar elongated conveying surface for transporting asphalt molds into the cooling means. In the embodiments shown in FIGS. 1–4, the cooling means comprise a pool of liquid coolant such as water. While the liquid coolant may comprise water that is sprayed onto the molds after they have been filled with hot asphalt, the coolant is preferably water contained in a pool. This pool also provides temporary storage and flotation for the filled molds. The pool is preferably constructed of artificial barriers or walls; however, it may also comprise a natural pond or some other means for holding water.

Figure 2:
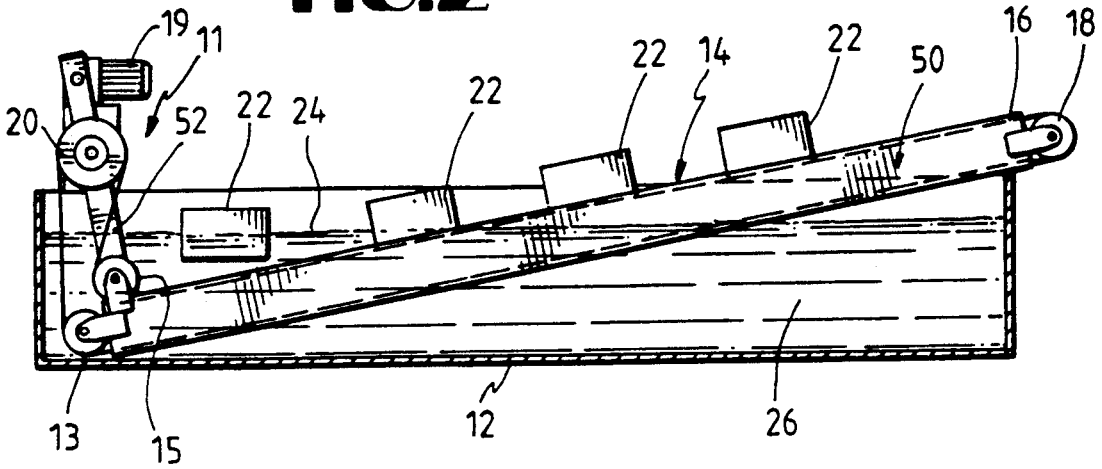
FIG. 2 is a side plan view of the conveying belt and rollers of the filling conveyor shown in FIG. 1.

The pool 12 in the drawings is constructed of concrete. The pool in FIGS. 1 and 2 is substantially rectangular in shape and dimensioned to accommodate a substantial number of asphalt molds. An example of a suitable pool has a length of from about 200 to 250 feet, a width of about 50 feet and height of about 2 feet. When filled with sufficient water, preferably more than about 8 inches of water and more preferably about 20 inches, the pool 12 serves as means for cooling the asphalt and for providing buoyancy and preferably transportation for the filled molds.

An important aspect of the invention is the conveying surface, which in a preferred aspect provides support for the molds as they are being lined with plastic bags and filled with hot asphalt. The surface should be elongated and substantially planar. In FIGS. 1–4, the conveying surface is the outer surface of a conveyor belt. The conveyor 14 is also referred to herein as the "filling" conveyor.

In general, the planar conveying surface should be substantially flat, but the invention is not restricted to the flat surface of a belt conveyor. The planar surface of the invention may also comprise an irregular surface that provides planar support for the molds described herein. For example, it is contemplated that a series of movable rollers or bearings capable of supporting the molds and transporting them in the direction of the pool will also serve as a planar conveying surface.

Preferably, the substantially planar conveying surface is movable, such as that provided by a series of rollers or the outer surface of a conveyor belt. However, the conveying surface may also be a stationary flat surface or ramp (not shown). Where the planar surface is a series of rollers disposed side-to-side as with a conventional roller conveyor (also not shown), each individual roller is stationary, but as it revolves provides movement to the mold tangential to the surface of the roller. When the substantially planar surface is provided by a ramp or series of rollers, it is contemplated that some external means for moving the molds in the desired direction is desirable. Such means may include, for example, moving the molds by hand or by mechanical means. Because a belt conveyor such as that shown in FIGS. 1–4 provides both support and movement to the mold, a belt conveyor is preferred.

In a preferred embodiment of the apparatus 11 of the invention, the filling conveyor 14 is at least partially disposed inside the pool 12 as shown in FIGS. 1–4. The conveyor 14 may be unattached to the pool 12 or it may be anchored in some way to the walls or floor of the pool. As shown in FIG. 1, the conveyer 14 should be parallel with and sufficiently close to the wall on side A of the pool 12 so that an operator may conveniently fill the molds 22 as they are being transported on the belt 16.

Figure 3:
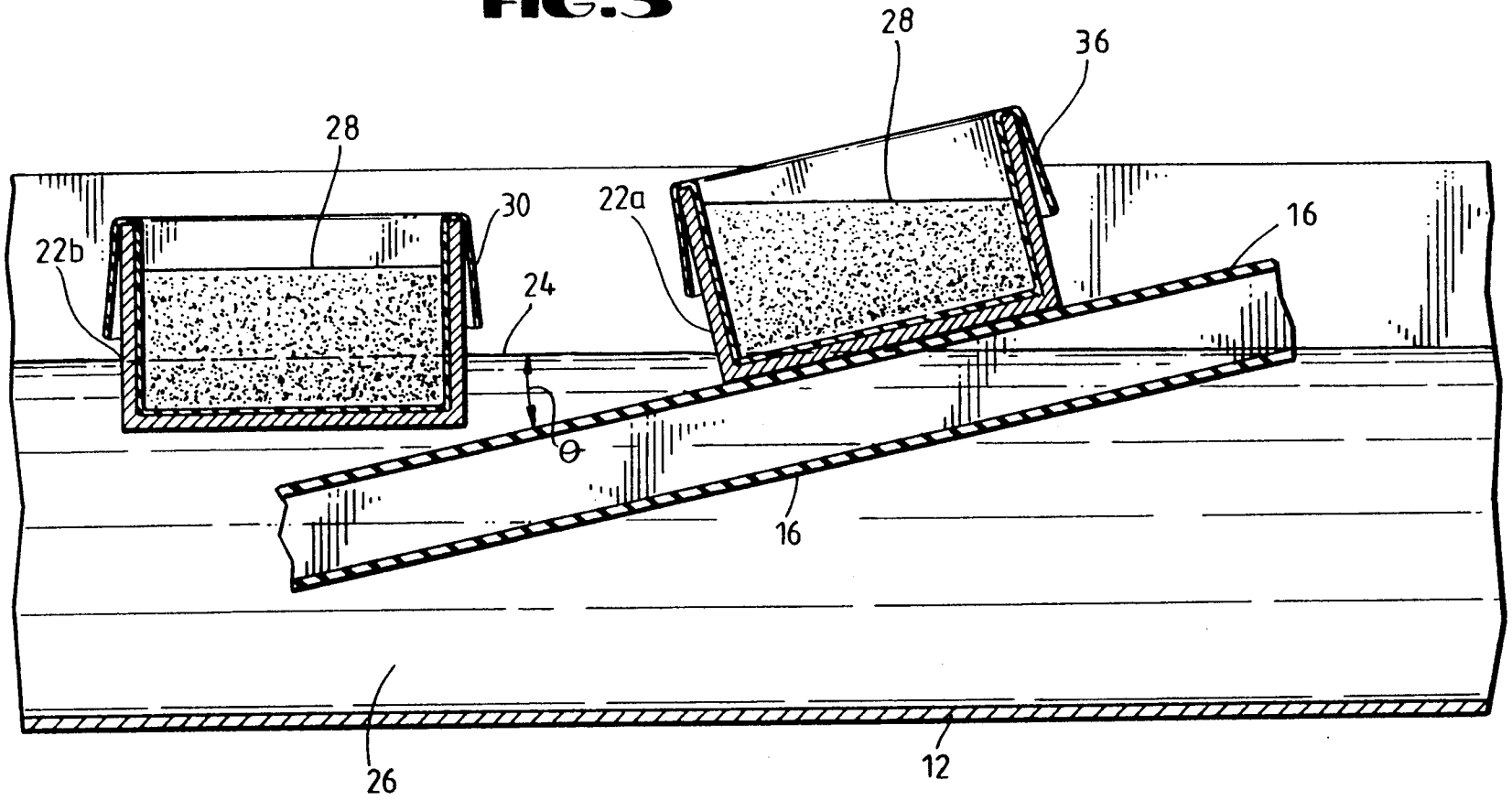
FIG. 3 is a cut-away side view of filled molds being transported into a pool of water on a conveyor belt of the invention.
Figure 4:
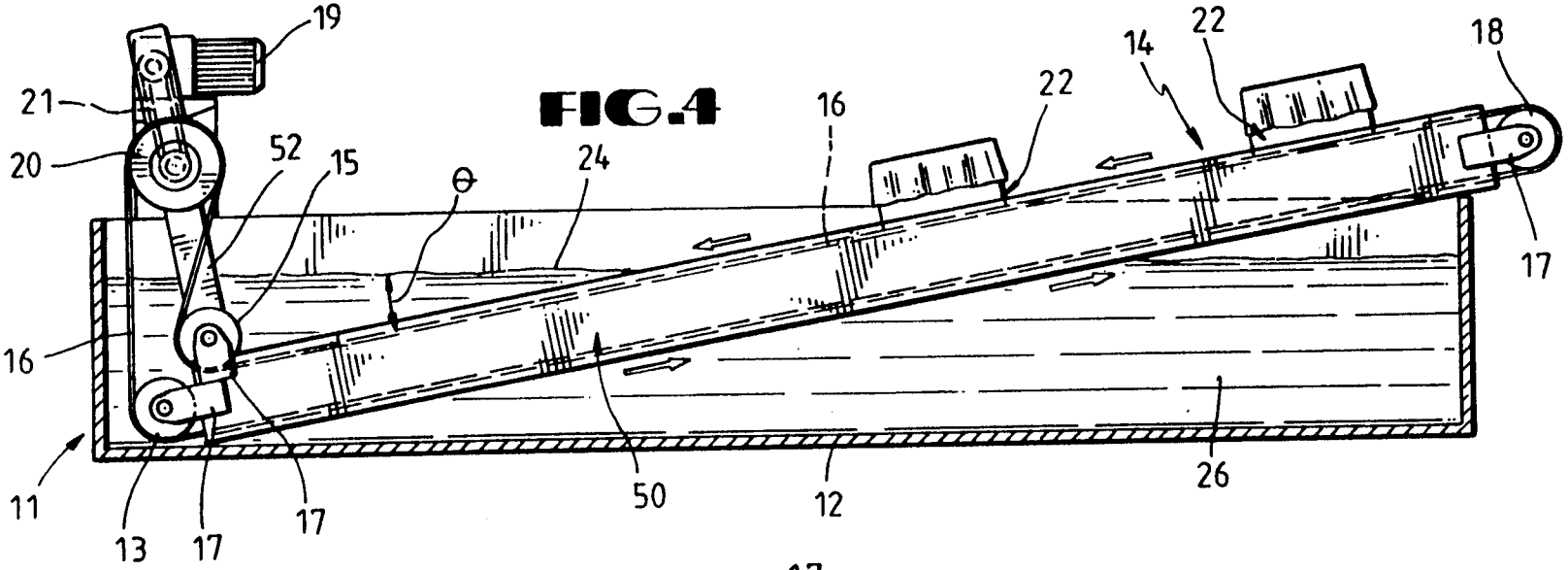
FIG. 4 is a side view of a conveyor belt system that may be used in accordance with this invention.

Filling conveyor 14 preferably includes a support member 50. In FIGS. 1 and 4, the support member comprises a wide flange beam, commonly referred to as an "I-beam." FIGS. 2 and 3 show the rollers and belt of the conveyor 14 without the beam while an I-beam is preferred, the support member may also comprise the wall A of pool 12, with the rollers that support the belt 16 disposed on shafts anchored to the wall of the pool. Alternatively, the support member may comprise separate frames or housings to support each roller. However, in a preferred embodiment of the invention, the support member comprises an I-beam that is unattached to the pool so that the entire conveyor assembly may be conveniently lifted out of the pool for repair or adjustment. The support beam 50 in FIG. 4 may be approximately 200 feet long beam and composed of five 40-foot long sections that are connected end-to-end by bolts or welding.

Figure 4A:
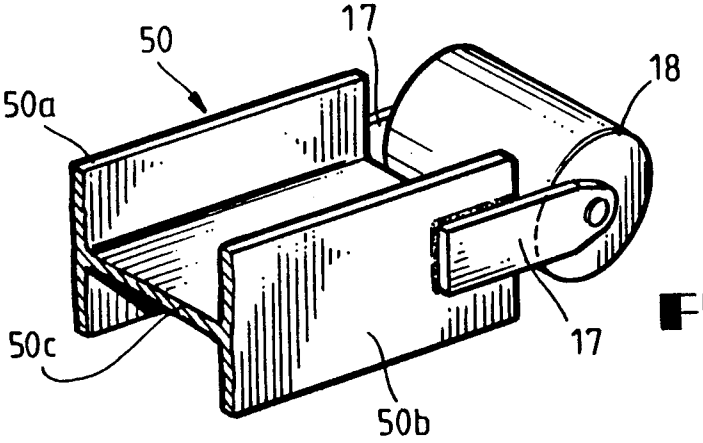
FIG. 4A is a partial side perspective view of an I-beam used for a conveyor of this invention.
Figure 5:
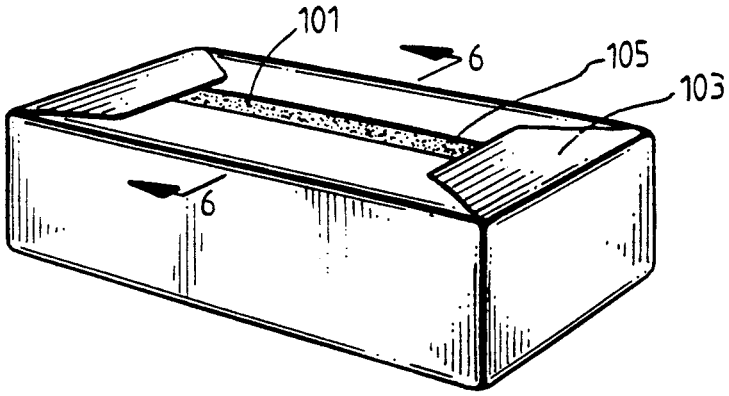
FIG.5 (PRIOR ART)
FIG. 5 is a perspective view of a package of roofing asphalt in accordance with the prior invention.
Figure 6:
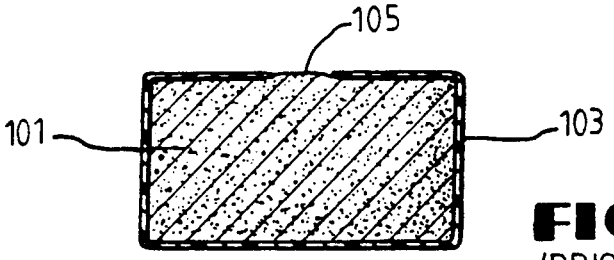
FIG.6 (PRIOR ART)
FIG. 6 is a cross-sectional view of the package of roofing asphalt of the prior invention.
Figure 7:
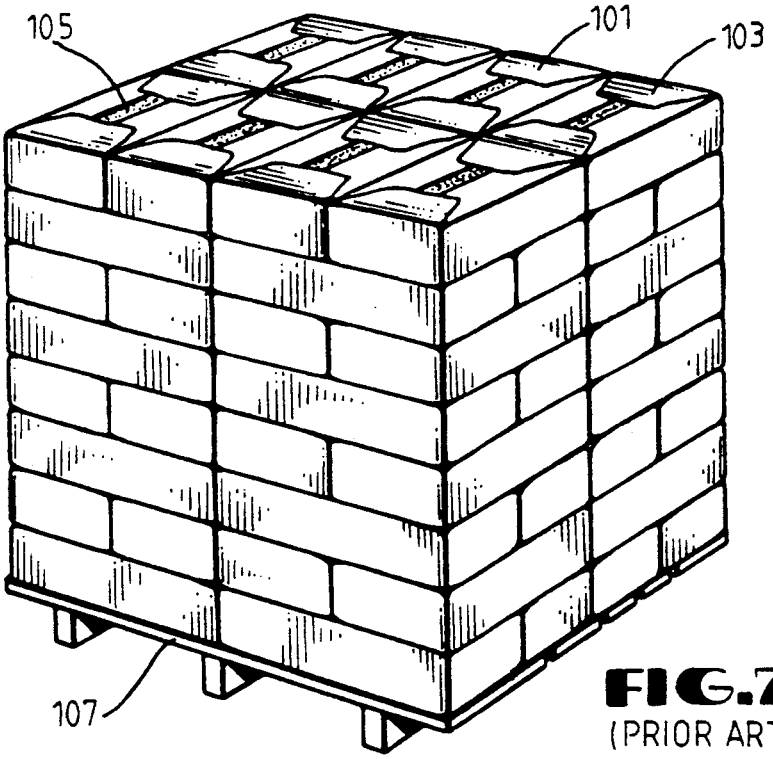
FIG.7 (PRIOR ART)
FIG. 7 is a perspective view of asphalt packages of the prior invention stacked upon a pallet.

A top perspective view of a cut-away section of the I-beam 50 proximate the tail roller 18 is shown in FIG. 4A. The beam 50 has two flange sides **50*a* and 50*b* connected by an inner plate 50*c*. The tail roller 18 moves freely around a shaft which is connected to beam 50 by two brackets or plates 17 that are bolted or welded or otherwise attached to either side of beam 50. The tail roller supports belt 16 (not shown) which in turn provides support and movement to molds. Lower auxiliary rollers 13 and 15 are attached to beam 50 in like manner, as indicated in FIG. 4**.

In FIG. 4, the support beam 50 is placed with the end proximate the tail roller 18 leaning on the upper edge of the wall of pool 12. The other end of beam 50 proximate the lower auxiliary rollers 13 and 15 rest on the floor of pool 12. A bracket 52 is connected at a substantially right angle to the support beam 50 and supports the inner side of auxiliary roller 15. A shaft connects support beam 50 and bracket 17, which supports the outer side of roller 15. Bracket 52 also supports the main head roller 20, which is connected to motor 19 via a belt or chain 21 revolving between the head roller shaft and a shaft that is powered by motor 19. When a belt 16 is disposed on the rollers as shown in FIG. 4, the belt advantageously is guided between the flange sides of the beam 50, thus providing side rails to prevent a mold 22 from falling off.

Conveyer 14 also includes a conveyor belt 16 with outer and inner surfaces that are movable relative to the water. In Figure 4, the belt 16 is indicated by broken lines. As shown in Figure 3, the outer belt surface faces upward and away from the water as 15 it supports molds placed thereon and as it moves toward the water in the pool to transport the molds thereto. The outer surface of the belt 16 is preferably made of a water resistant material such as polyvinylchloride.

In a preferred embodiment of the invention and referring to FIG. 4, the head roller 20 proximate but above the lower end of conveyor 14 drives the belt 16. The head roller 20 is connected to an hydraulic motor 19 via a drive belt 21 for rotating the head roller 20 and for causing the belt 16 to transport molds 22 toward the liquid cooling means. The tail roller 18 at the upper end of conveyor 14 revolves freely during movement of belt 16. Tail roller 18 supports belt 16, so that after the filled molds float away from the outer surface of the belt 16, the outer surface eventually returns to the tail roller 18. The conveyor 14 also includes an upper auxiliary roller 15 and a lower auxiliary roller 13, both of which support the belt 16 at a lower elevation in the pool as shown in FIG. 4 and rotate freely as the belt moves in the direction indicated by the arrows.

The positions of the auxiliary rollers 13 and 15 under water cause a portion of the belt to be partially submerged. In a specific embodiment, the head roller 20 is 16 inches in diameter while the tail and auxiliary rollers are 10 inches in diameter. The tail and auxiliary rollers rotate around shafts that are connected to beam 50. However, as described previously, it is also contemplated that these shafts may also be anchored to the wall of the pool 12.

Motor 19 may be a hydraulic motor, powered by hydraulic fluid that is pumped via lines by a remote pump (not shown). The type, size and horsepower of the motor 19 will depend on the force required to move the conveyor belt 16 around the rollers. It has been discovered that a conventional two-horsepower hydraulic motor is suitable for moving the conveyor belt of the invention. As will be recognized by persons skilled in the art, other means besides a hydraulic motor are available to move the conveyor belt 16 and transport the molds into the water, including a conventional gasoline or diesel engine, or even an electric motor connected directly to the head roller 20.

In a preferred embodiment of the invention, the elongated conveying surface is slanted with respect to the surface of the water in the pool, to provide for gradual immersion of the molds into the water. While the conveying surface may be fully submerged, it is preferably at least partially submerged. It should be configured so that an empty mold can be placed on the surface in a first position without floating and transported to a second position where the surface is submerged so that the filled mold floats on the water and moves away from the conveying surface. Preferably, the mold is transported from the first position to the second position by movement of the conveying surface. The empty mold should be lined with a packaging material, such as a plastic bag, and filled with hot molten asphalt between the first and second positions.

The term "slanted" refers to the orientation of the conveying surface of the conveyor belt 16 with respect to the surface 24 of the water in the pool 12. Advantageously, as shown in FIG. 4, the end of the belt 16 proximate the tail roller 18 is elevated at a height above that of the end of belt 16 proximate the auxiliary rollers. This elevation enables a person to easily place an empty mold on the conveying surface of the belt after removing the mold from the pool and emptying the packaged asphalt from the mold.

Another benefit of the slanted configuration of the conveying surface of belt 16 involves the loading or filling of the molds. After being placed on the conveying surface of the belt 16, the molds may be filled with plastic bags and hot asphalt while the slanted surface is still moving. Preferably, the molds are lined with bags and filled with hot asphalt before they reach the intersection of the belt 16 surface with the waterline 24. It has been discovered that if the molds 22 contact the water 26 prior to being filled with hot asphalt, they may tend to float and move away from the conveyor belt surface, thus making them more difficult to fill.

FIG. 3 illustrates the preferred slanted configuration of conveyor belt 16 with respect to the transportation of filled molds to the cooling operation. The slant of the belt surface has been exaggerated in FIG. 3 to illustrate the gradual immersion of the filled molds into the water. A cut-away view of mold **22*a* is shown on conveyor belt 16 after having already been lined with plastic bag 30 and filled with hot asphalt 28. Mold 22*a* has been filled with the hot asphalt prior to contacting the surface 24 of the water. Mold 22*b* is shown floating in the water shortly after leaving the surface of the belt 16. Depending on the amount of asphalt, mold 22*b* will typically float much lower in the water than shown in FIG. 3, due to the weight of the asphalt. The movement of filled molds 22 away from the conveyor belt 16 once the molds begin to float in the water is shown in FIG. 1**.

The conveyor surface should have different elevations relative to the surface of the water in the pool or pond. One end of the belt surface is preferably above the water so that an empty mold may be placed on the belt, lined with a plastic bag and filled with hot asphalt. The other end of the belt surface is preferably submerged so that a filled mold will float as it gradually and controllably moves into deeper water by movement of the conveyor belt. In FIGS. 1–4, the conveyor surface is the outer surface of the slanted conveyor belt 16. The slant of the belt surface relative to the surface of the water is indicated by angle $\theta$ in FIGS. 3 and 4. This angle is between 0° and 45° and is preferably less than about 15°. On the one hand, the slant of the belt surface should be sufficient to provide different elevations to the same flat surface of belt 16. On the other hand, the belt surface should not be so slanted that the mold slides uncontrollably into the water. Further, if the belt surface is too slanted, the hot asphalt may not be evenly distributed in the lined mold. Thus, referring to FIGS. 3 and 4, it is preferred that the angle $\theta$ of the conveying surface be very small, such as that provided by a conveyor belt with an elevational difference between rollers 13 and 18 of approximately 2 feet and a horizontal difference of approximately 200 feet.

Also provided are means for filling the molds with hot asphalt. FIG. 1 shows a conventional storage tank 60 for holding hot asphalt located proximate the pool 12. The tank 60 preferably includes a heater (not shown) for maintaining the asphalt in a melted state. A pipe 62 provides circulation of the hot asphalt to the filling location 48 and back to the tank 60. Preferably, a valve 64 is attached to the pipe 62 to regulate flow of hot asphalt to an outlet pipe or downspout 66. During a filling operation, the valve 64 may be opened by an operator and hot asphalt poured into a bag-lined mold on the conveyor belt.

Figure 2A:
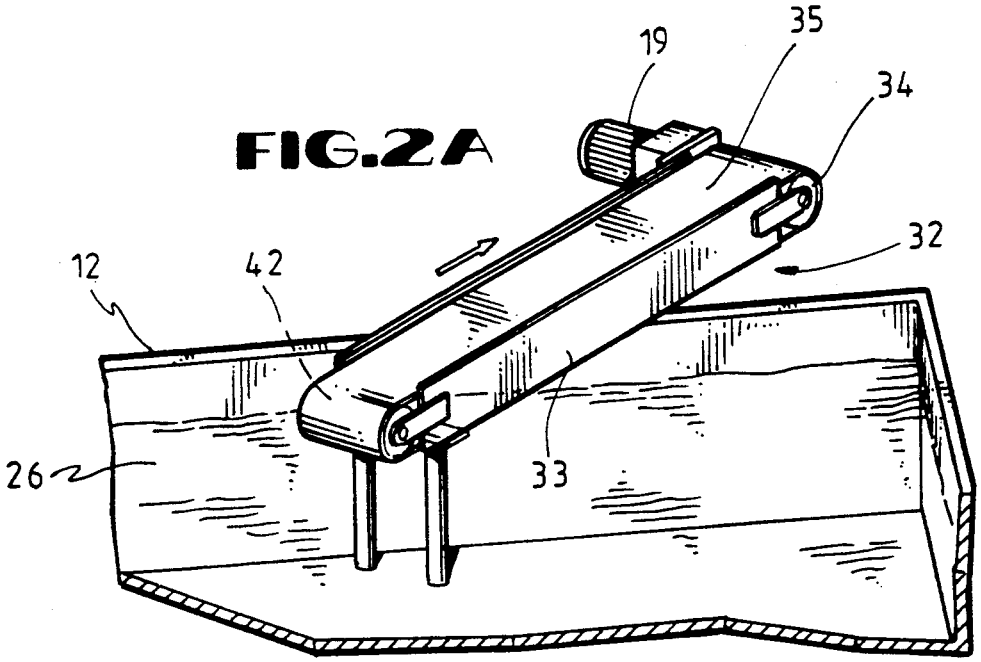
FIG. 2A is a perspective side view of the take-out conveyor shown in FIG. 1.

The apparatus should also include means for removing the filled molds from the pool. Preferably, the means for removing the molds 22 from the pool 12 comprises an elongated flat conveying surface such as a take-out conveyor 32 shown in FIGS. 1 and 2A. Preferably, this conveyor 32 is a slider bed conveyor similar to but shorter than the filling conveyor 14. As shown in FIG. 2A, this take-out conveyor 32 may include an I-beam support member 33. Unlike filling conveyor 14, the take-out conveyor 32 should include only two rollers 42 and 34, with a conveyor belt 35 disposed between them. As shown in FIG. 2A, the tail roller 42 is supported by support legs and is partially submerged in the water to receive filled asphalt molds and transport them along belt 35 which moves in the direction indicated by the arrows. The head roller 34 is connected to a motor or other means for rotating the head roller 34 and causing the belt 35 to move. As shown in FIG. 1, the take-out conveyor 32 is preferably located on the opposite side of the pool 12 from the point at which the filled molds 22 enter the pool, or at least a sufficient distance that the hot asphalt may be cooled and hardened before it is removed with the mold at the take-out conveyor.

In a specific embodiment of the invention, the apparatus also includes means for transporting the asphalt-filled mold to the take-out conveyor 42 for removal. Preferably, these transport means comprise at least one suction pump 33 located on the left end of the pool 12 and connected by line 36 to at least one inlet 38 located on the right side of pool 12 as shown in FIG. 2. When activated, the suction pump generates a current in the water toward the take-out conveyor as indicated by the arrows in the water 26.

Besides simplicity of operation, another beneficial feature of the invention is that a relatively small number of persons may operate the apparatus and method. For example, four persons may efficiently operate the entire system from stationary positions. An operator at position 40 places filled molds from the lower end 42 of the take-out conveyor 32 and turns the molds upside down on the surface of the conveyor to remove the packaged hardened asphalt, much the same way one might empty an ice cube tray. He leaves the packaged asphalt (not shown) on the moving belt of conveyor 32 and places the empty mold on the filling conveyor 14 proximate the tail roller 18. Another operator stationed at position 44 receives this packaged asphalt from the surface of take-out conveyor 32 and places it on a pallet or on a stack of asphalt blocks that have already been placed o the pallet. A third operator stationed at position 46 fills the empty molds as they are being transported along the conveyor 14 with plastic bags 30 to line the walls of the molds for receiving hot asphalt. Still another operator stationed at position 48 fills the lined molds with hot asphalt as described above.

While this invention has been described with reference to certain specific examples and embodiments, a person skilled in the art will recognize many variations without departing from the overall invention. For example, the liquid cooling means may involve the use of a water spray system. As discussed herein, a variety of conveying surfaces may be provided, for example, by a ramp or roller conveyor. Accordingly, the invention described by the claims is intended to cover all changes and modifications of the invention which provide similar advantages and benefits but do not depart from the spirit of the invention.

What is claimed is:

1. A method of packaging asphalt, comprising the steps of:

filling a floatable mold with hot molten asphalt;

transporting said mold along an elongated conveying surface toward a pool containing water, said mold being transported downward at an angle with respect to the surface of the water;

floating said mold in said water;

cooling said asphalt in said mold; and removing said mold from the water.

2. The method of claim 1 wherein said angle is less than about 15° with respect to the surface of the water.

3. A method of packaging asphalt, comprising the steps of:

filling a mold with hot asphalt to provide a filled mold;

transporting said filled mold along an elongated conveying surface toward a liquid cooling means; and contacting said mold with said liquid cooling means;

wherein the mold is floatable and is removed from said cooling means after the asphalt has been cooled and hardened.

4. A method of packaging asphalt, comprising the steps of:

lining a mold with a packaging liner;

filling said mold with hot asphalt to provide a filled mold;

transporting said filled mold along an elongated conveying surface toward a pool of water; and contacting said mold with said water.

5. The method of claim 4 wherein the mold is transported at an angle with respect to the surface of the water.

6. The method of claim 5 wherein the angle is between 0° and 45°.

7. The method of claim 4 wherein the mold is transported at an angle of less than about 15° with respect to the surface of the water.

8. The method of claim 5 wherein the filled mold is transported into floatable contact with the water.

9. An apparatus for packaging asphalt, comprising:

a pool containing water;

an asphalt dispenser for filling asphalt molds with molten asphalt above the surface of the water; and a conveyor system for transporting said filled asphalt molds for floatable contact with said water;

said conveyor system comprising an elongated conveying surface which is slanted at an angle with respect to said water;

10. The apparatus of claim 9 wherein said angle is between 0° and 45°.

11. The apparatus of claim 9 wherein said angle is less than about 15°.

12. The apparatus of claim 9 wherein said slanted conveying surface is partially submerged, a first portion of said conveying surface being disposed above said pool surface and a second portion of said conveying surface being submerged below said pool surface, such that said asphalt molds will maintain contact with said conveying surface without floating prior to being filled with asphalt.

* * * * *

UNITED STATES PATENT AND TRADEMARK OFFICE

CERTIFICATE OF CORRECTION

PATENT NO. : 5,307,608
DATED : May 3, 1994
INVENTOR(S) : Raun S. Muir and Charles S. Rogers It is certified that error appears in the above-indentified patent and that said Letters Patent is hereby corrected as shown below:

Column 1, line 62, change "1 TM to --1/2--.

Column 2, line 29, change "40" to --401--.

Column 6, line 68, delete "15".

Column 9, line 49, change "o" to --on--.

Signed and Sealed this

Eighteenth Day of October, 1994

*Attest:*

*Attesting Officer*

BRUCE LEHMAN

*Commissioner of Patents and Trademarks*